US009874031B2

(12) United States Patent
Villarreal

(10) Patent No.: US 9,874,031 B2
(45) Date of Patent: Jan. 23, 2018

(54) DRYWALL TEXTURE DISPENSING SYSTEM

(71) Applicant: Ignacio Villarreal, Oregon City, OR (US)

(72) Inventor: Ignacio Villarreal, Oregon City, OR (US)

( * ) Notice: Subject to any disclaimer, the term of this patent is extended or adjusted under 35 U.S.C. 154(b) by 0 days.

(21) Appl. No.: 15/161,467

(22) Filed: May 23, 2016

(65) Prior Publication Data

US 2017/0335576 A1 Nov. 23, 2017

(51) Int. Cl.
*B05B 7/24* (2006.01)
*E04F 21/02* (2006.01)
*E04F 21/16* (2006.01)

(52) U.S. Cl.
CPC ..... *E04F 21/02* (2013.01); *B05B 7/241* (2013.01); *B05B 7/2478* (2013.01); *E04F 21/16* (2013.01)

(58) Field of Classification Search
CPC ..... B05B 7/241; B05B 7/2408; B05B 1/16; B05B 1/1672; B05B 7/2478; B65D 73/0085; B65D 73/0042
USPC ..... 239/302, 600
See application file for complete search history.

(56) References Cited

U.S. PATENT DOCUMENTS

| | | | | |
|---|---|---|---|---|
| 4,948,054 | A | 8/1990 | Mills | |
| 6,179,224 | B1 * | 1/2001 | Huesken | A47L 13/26 239/152 |
| D535,339 | S | 1/2007 | Broersma | |
| 7,617,995 | B2 | 11/2009 | Florio | |
| 7,717,354 | B1 * | 5/2010 | Robinson | A45F 5/02 239/1 |
| 7,861,950 | B2 | 1/2011 | Rossner et al. | |
| 8,210,449 | B2 | 7/2012 | Peterson et al. | |
| 2011/0079321 | A1 | 4/2011 | Mattson | |
| 2011/0297754 | A1 | 12/2011 | Valdez | |

FOREIGN PATENT DOCUMENTS

| | | |
|---|---|---|
| WO | WO2009137639 | 11/2009 |

* cited by examiner

*Primary Examiner* — Arthur O Hall
*Assistant Examiner* — Tuongminh Pham

(57) ABSTRACT

A drywall texture dispensing system includes an air gun that may be fluidly coupled to an air source. A reservoir is provided and the reservoir may contain a fluid. The reservoir is removably coupled to the air gun such that the reservoir is in fluid communication with the air gun. The reservoir has a diameter that is less than approximately thirty cm. Thus, the reservoir facilitates the air gun to dispense the fluid in a restricted area. A lid is removably coupled to the reservoir.

4 Claims, 5 Drawing Sheets

DRYWALL TEXTURE DISPENSING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to dispensing devices and more particularly pertains to a new dispensing device for dispensing drywall texture in a spatially restricted area.

BRIEF SUMMARY OF THE INVENTION

An embodiment of the disclosure meets the needs presented above by generally comprising an air gun that may be fluidly coupled to an air source. A reservoir is provided and the reservoir may contain a fluid. The reservoir is removably coupled to the air gun such that the reservoir is in fluid communication with the air gun. The reservoir has a diameter that is less than approximately thirty cm. Thus, the reservoir facilitates the air gun to dispense the fluid in a restricted area. A lid is removably coupled to the reservoir.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
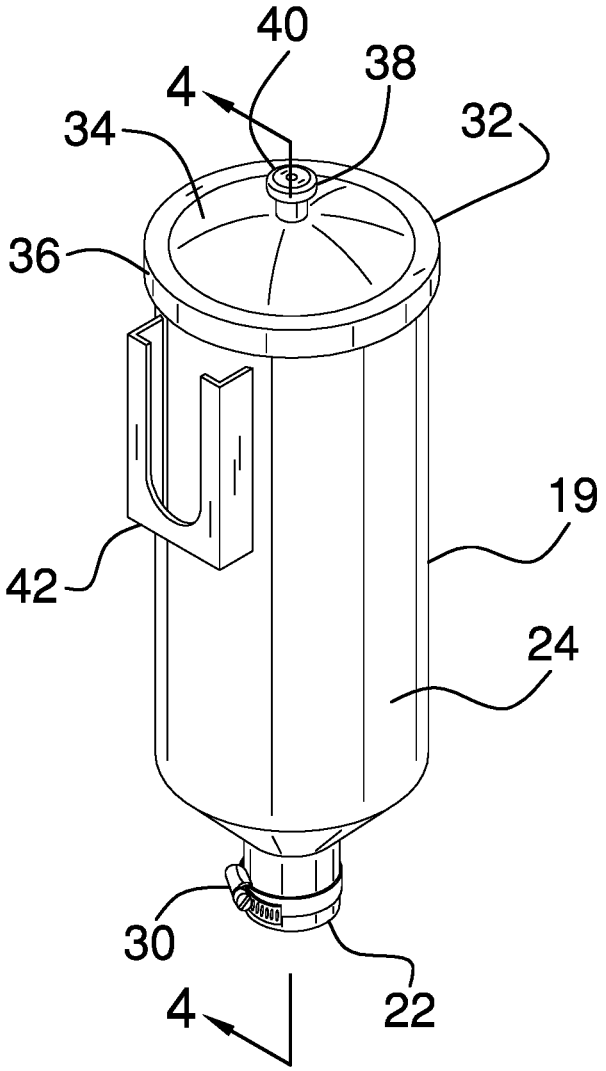
FIG. 1 is a perspective view of a drywall texture dispensing system according to an embodiment of the disclosure.
Figure 2:
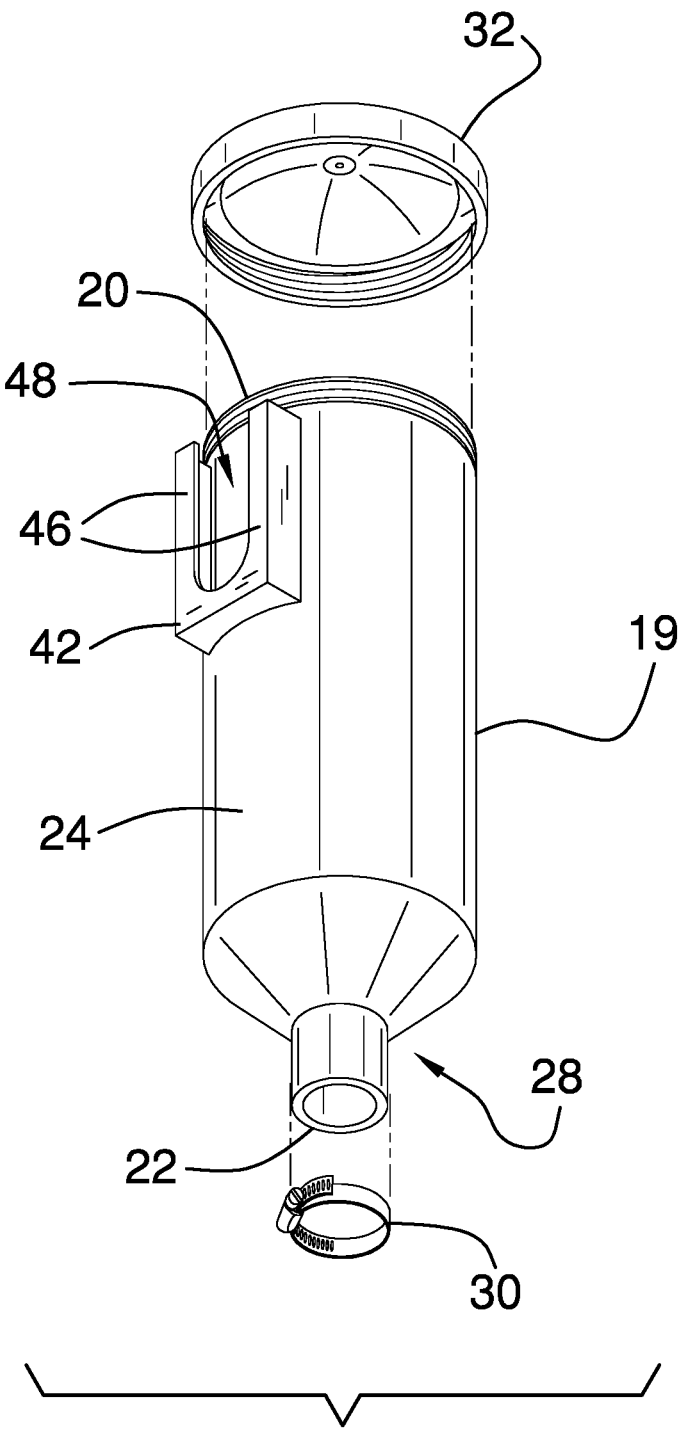
FIG. 2 is an exploded perspective view of an embodiment of the disclosure.
Figure 3:
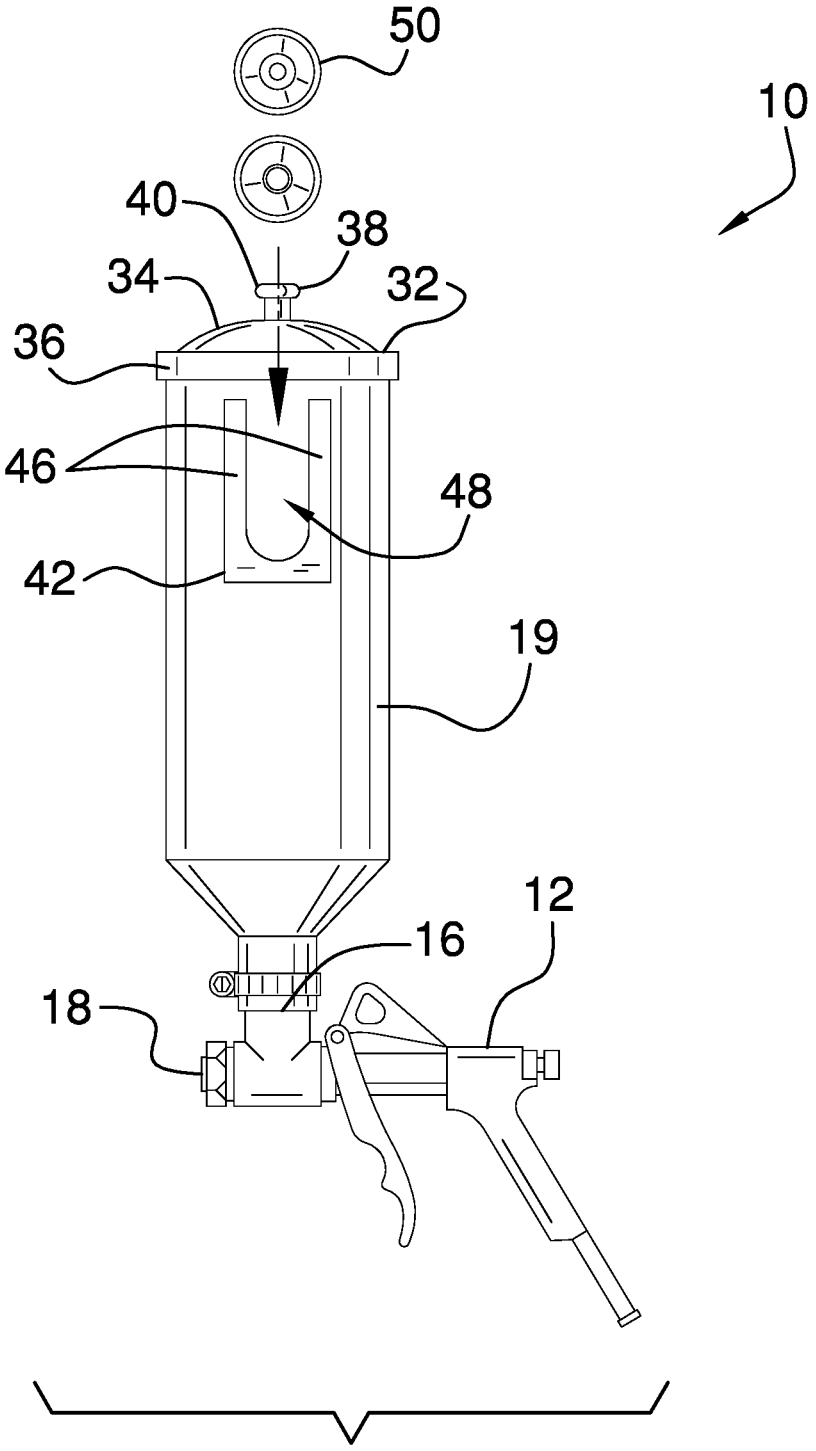
FIG. 3 is a left side view of an embodiment of the disclosure.
Figure 4:
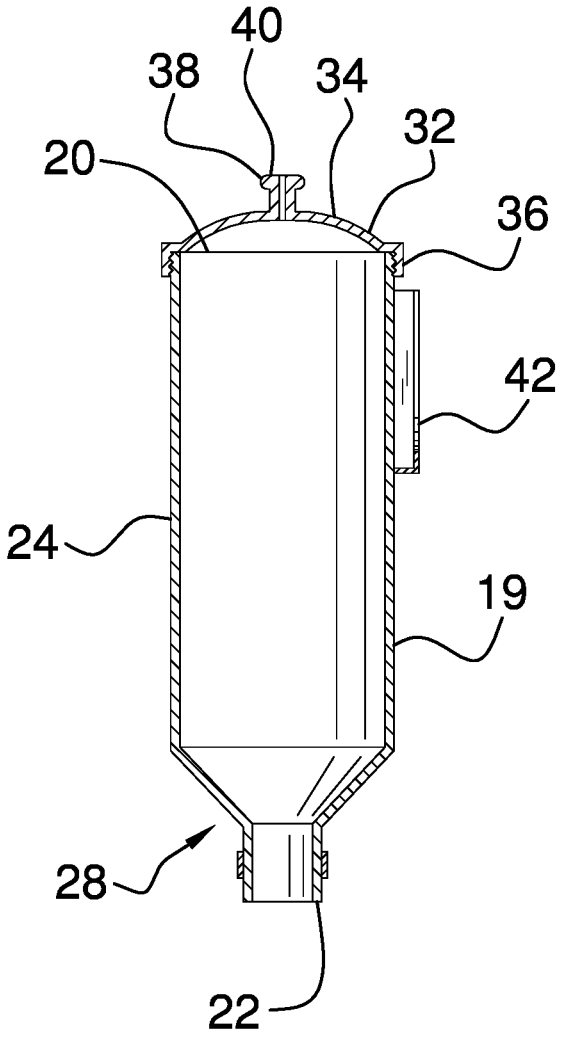
FIG. 4 is a cross sectional view taken along line of an embodiment of the disclosure.
Figure 5:
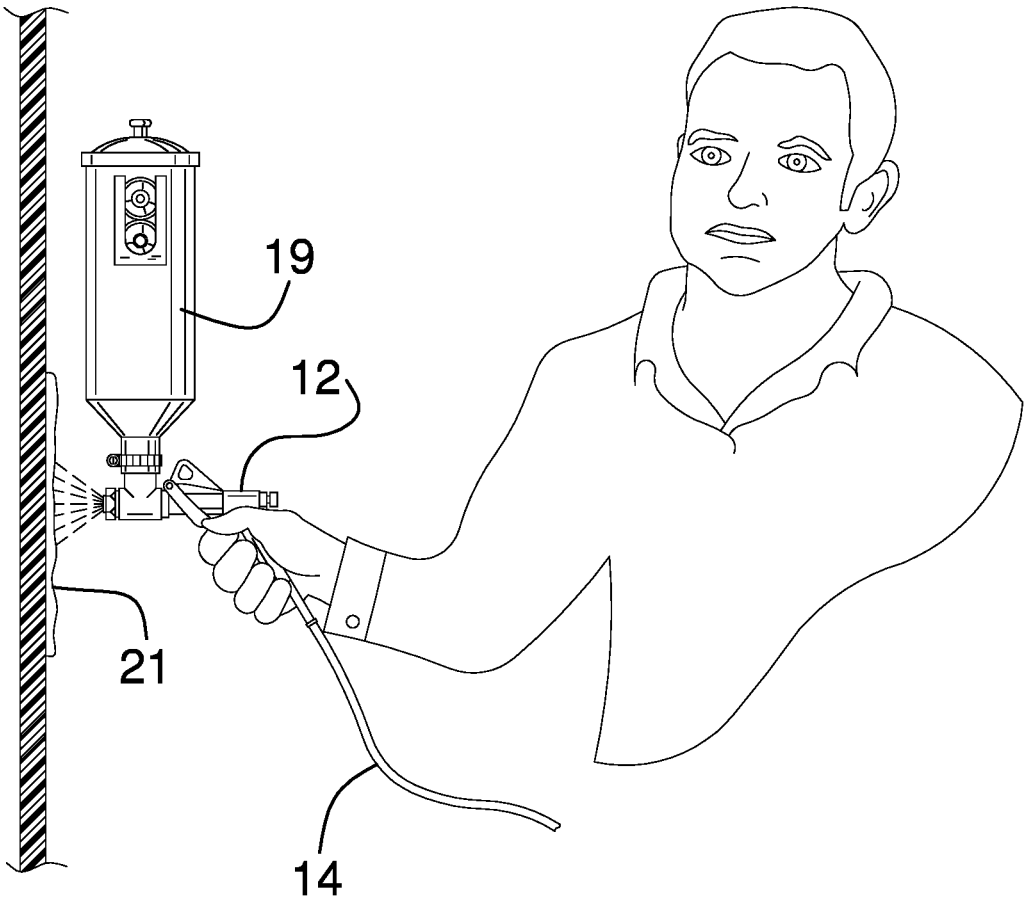
FIG. 5 is a perspective in-use view of an embodiment of the disclosure.

With reference now to the drawings, and in particular to FIGS. 1 through 5 thereof, a new dispensing device embodying the principles and concepts of an embodiment of the disclosure and generally designated by the reference numeral 10 will be described.

As best illustrated in FIGS. 1 through 5, the drywall texture dispensing system 10 generally comprises an air gun 12 that may be fluidly coupled to an air source 14. The air gun 12 has an intake 16 and an exhaust 18. The air gun 12 may comprise a dry wall texturing gun or the like. The air source 14 may comprise an air compressor or the like.

A reservoir 19 is provided and the reservoir 19 may contain a fluid 21. The fluid 21 may comprise dry wall texturing compound or the like. The reservoir 19 is removably coupled to the air gun 12 such that the reservoir 19 is in fluid communication with the air gun 12. The reservoir 19 has a diameter that is less than approximately thirty cm. Thus, the reservoir 19 facilitates the air gun 12 to dispense the fluid 21 in a restricted area.

The reservoir 19 has a top end 20, a bottom end 22 and an outer wall 24 extending therebetween. The outer wall 24 has an outer surface 26 and the outer surface 26 is threaded adjacent to the top end 20. Each of the top end 20 and the bottom end 22 are open. The outer wall 24 is continuous such that the reservoir 19 has a cylindrical shape. Moreover, the outer wall 24 tapers inwardly proximate the bottom end 22 to define a funnel 28. The bottom end 22 selectively insertably receives the intake 16 of the air gun 12. Thus, the reservoir 19 may deliver the fluid 21 into the air gun 12.

A retainer 30 is provided. The retainer 30 is continuous such that the retainer 30 forms a closed loop. The retainer 30 is positionable around the bottom end 22. The retainer 30 may tightened to compress the bottom end 22 around the intake 16. Thus, the retainer 30 is retained on the air gun 12. The retainer 30 may comprise a hose clamp or the like.

A lid 32 is provided and the lid 32 is removably coupled to the reservoir 19. The lid 32 has a first wall 34 and a peripheral wall 36 extending downwardly from the first wall 34. The peripheral wall 36 is continuous such that the lid 32 has a disk shape. The peripheral wall 36 threadably engages the outer wall 24 such that the lid 32 covers the top end 20. Thus, the lid 32 inhibits the fluid 21 from spilling out of the reservoir 30.

The lid 32 has a nozzle 38 extending upwardly from the first wall 34. The nozzle 38 has a distal end 40 with respect to the first wall 34. The distal end 40 is open to allow air to pass into the reservoir 19. Thus, the air gun 12 may selectively expel the fluid 21 outwardly from the exhaust 18 on the air gun 12.

A saddle 42 is coupled to the outer wall 24 of the reservoir 19. The saddle 42 has a pair of spaced portions 46 to define a slot 48 in the saddle 42. Thus, the slot 48 may insertably receive at least one nozzle 50 for the air gun 12 to store the at least one nozzle 50. The at least one nozzle 50 may comprise a drywall texture nozzle or the like.

In use, the reservoir 30 is coupled to the air gun 12. The fluid 21 is poured into the reservoir 30 and the lid 32 is coupled to the reservoir 30. The air gun 12 is manipulated to spray the fluid 21 on a wall or the like. The diameter of the reservoir 30 facilitates the air gun 12 to be manipulated in an area inaccessible to a traditional texture hopper.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A drywall texture dispensing system comprising:

an air gun being configured to be fluidly coupled to an air source, said air gun having an intake and an exhaust;

a reservoir being configured to contain a fluid, said reservoir being removably coupled to said air gun such that said reservoir is in fluid communication with said air gun, said reservoir having a diameter being less than approximately thirty cm wherein said reservoir is configured to facilitate said air gun to dispense the fluid in a restricted area, said reservoir having a top end, a bottom end and an outer wall extending therebetween, each of said top and said bottom end being open, said outer wall being continuous such that said reservoir has a cylindrical shape, said outer wall tapering inwardly proximate said bottom end to define a funnel, said bottom end insertably receiving said intake wherein said reservoir is configured to deliver the fluid into said air gun, said outer wall having an outer surface, said outer surface being threaded adjacent to said top end;

a saddle being coupled to said outer wall of said reservoir, said saddle having a pair of spaced portions to define a slot in said saddle wherein said slot is configured to insertably receive a plurality of disc-shaped nozzles for said air gun in a vertically stacked orientation thereby facilitating the nozzles to be stored, said spaced portions extending downwardly from a top of said saddle defining an open front to said slot whereby said slot is configured to expose a center of a bottommost one of said nozzles vertically stacked within said slot; and a lid being removably coupled to said reservoir.

2. The system according to claim 1, wherein said lid has a first wall and a peripheral wall extending downwardly from said first wall, said peripheral wall being continuous such that said lid has a disk shape, said peripheral wall threadably engaging said outer wall such that said lid covers said top end.

3. The system according to claim 2, wherein said lid has a nozzle extending upwardly from said first wall.

4. A drywall texture dispensing system comprising:

an air gun being configured to be fluidly coupled to an air source, said air gun having an intake and an exhaust;

a reservoir being configured to contain a fluid, said reservoir being removably coupled to said air gun such that said reservoir is in fluid communication with said air gun, said reservoir having a diameter being less than approximately twelve cm wherein said reservoir is configured to facilitate said air gun to dispense the fluid in a restricted area, said reservoir having a top end, a bottom end and an outer wall extending therebetween, each of said top and said bottom end being open, said outer wall being continuous such that said reservoir has a cylindrical shape, said outer wall tapering inwardly proximate said bottom end to define a funnel, said bottom end insertably receiving said intake wherein said reservoir is configured to deliver the fluid into said air gun, said outer wall having an outer surface, said outer surface being threaded adjacent to said top end;

a lid being removably coupled to said reservoir, said lid having a first wall and a peripheral wall extending downwardly from said first wall, said peripheral wall being continuous such that said lid has a disk shape, said peripheral wall threadably engaging said outer wall such that said lid covers said top end, said lid having a nozzle extending upwardly from said first wall, said nozzle having a distal end with respect to said first wall, said distal end being open such wherein said nozzle is configured to allow air to pass into said reservoir thereby facilitating said air gun to selectively expel the fluid outwardly from said exhaust on said air gun; and a saddle being coupled to said outer wall of said reservoir, said saddle having a pair of spaced portions to define a slot in said saddle wherein said slot is configured to insertably receive a plurality of disc-shaped nozzles for said air gun in a vertically stacked orientation thereby facilitating the nozzles to be stored, said spaced portions extending downwardly from a top of said saddle defining an open front to said slot whereby said slot is configured to expose a center of a bottommost one of said nozzles vertically stacked within said slot.

* * * * *